US008567364B2

(12) United States Patent
Usami et al.

(10) Patent No.: US 8,567,364 B2
(45) Date of Patent: Oct. 29, 2013

(54) STARTER EQUIPPED WITH PLANETARY SPEED REDUCER AND SHOCK ABSORBER

(75) Inventors: Shinji Usami, Okazaki (JP); Sadayoshi Kajino, Nagoya (JP); Youichi Hasegawa, Kasugai (JP)

(73) Assignee: Denso Corporation, Kariya (JP)

( * ) Notice: Subject to any disclaimer, the term of this patent is extended or adjusted under 35 U.S.C. 154(b) by 1044 days.

(21) Appl. No.: 12/588,584

(22) Filed: Oct. 20, 2009

(65) Prior Publication Data

US 2010/0101524 A1 Apr. 29, 2010

(30) Foreign Application Priority Data

Oct. 24, 2008 (JP) ..... 2008-274123

(51) Int. Cl.

| | |
|---|---|
| ***F02N 11/00*** | (2006.01) |
| ***F02N 15/02*** | (2006.01) |
| ***F02N 15/04*** | (2006.01) |
| ***F02N 15/06*** | (2006.01) |

(52) U.S. Cl.

USPC ..... 123/179.25; 74/7 E

(58) Field of Classification Search

USPC ..... 123/179.1, 179.25, 185.5, 185.6, 185.8, 123/185.9, 192.1; 290/38 R, 48; 74/7 E

See application file for complete search history.

(56) References Cited

U.S. PATENT DOCUMENTS

| | | | | |
|---|---|---|---|---|
| 2,679,170 | A * | 5/1954 | Prittie | 475/159 |
| 5,905,309 | A * | 5/1999 | Ohmi et al. | 290/36 R |
| 5,905,310 | A * | 5/1999 | Nagao | 290/46 |
| 6,997,072 | B2 * | 2/2006 | Saito et al. | 74/7 E |
| 7,018,314 | B2 * | 3/2006 | Hasegawa et al. | 475/5 |
| 2004/0123686 | A1 * | 7/2004 | Kajino et al. | 74/7 E |
| 2008/0196544 | A1 | 8/2008 | Kajino et al. | |

FOREIGN PATENT DOCUMENTS

| | | |
|---|---|---|
| JP | U 59-96459 | 6/1984 |
| JP | A 1-316558 | 12/1989 |
| JP | A 2004-232785 | 8/2004 |
| JP | A 2008-95322 | 4/2008 |
| JP | A-2008-202507 | 9/2008 |
| JP | A-2008-223572 | 9/2008 |

OTHER PUBLICATIONS

Sep. 25, 2012 Office Action issued in Japanese Patent Application No. 2008-274123 (with translation).

* cited by examiner

*Primary Examiner* — Stephen K Cronin
*Assistant Examiner* — Sizo Vilakazi
(74) *Attorney, Agent, or Firm* — Oliff & Berridge, PLC

(57) ABSTRACT

A starter for an engine is equipped with a planetary gear speed reducer, a restraining mechanism, and a shock absorber which is made up of a rotary disc, a stationary disc, a case, and a load applying mechanism. The load applying mechanism applies a load to the stationary and rotary discs to develop a given degree of friction therebetween. When an excessive torque acts on the rotary disc through the internal gear, the shock absorber induces the rotary disc to rotate against the given degree of friction to absorb the torque to eliminate a physical impact to be exerted on the planetary gear speed reducer. The restraining mechanism restrains the load applying mechanism from moving in a radius direction of the internal thread to avoid undesirable engagement of the load applying mechanism with the internal thread, thereby ensuring the stability in applying the load to the stationary and rotary discs.

13 Claims, 6 Drawing Sheets

STARTER EQUIPPED WITH PLANETARY SPEED REDUCER AND SHOCK ABSORBER

CROSS REFERENCE TO RELATED DOCUMENT

The present application claims the benefit of Japanese Patent Application No. 2008-274123 filed on Oct. 24, 2008, the disclosure of which is incorporated herein by reference.

BACKGROUND OF THE INVENTION

1. Technical Field of the Invention

The present invention relates generally to a starter designed to start engines such as automotive internal combustion engines, and more particularly to such a starter equipped with a planetary gear speed reducer and a shock absorber working to absorb impact torque acting on the starter which will arises upon cranking of the engine.

2. Background Art

Japanese Patent First Publication No. 2008-223572, assigned to the same assignee as that of this application, discloses a starter equipped with a multi-disc type shock absorber which includes a plurality of rotary discs formed integrally with an internal gear of a planetary gear speed reducer, a plurality of stationary discs each of which is disposed adjacent two of the rotary discs, and disc springs serving to exert pressure on the stationary and rotary discs to develop mechanical friction therebetween.

When a degree of torque greater than or equal to slip torque preset for the rotary discs is exerted on the rotary discs through the internal gear, it will cause the rotary discs to slip on the stationary discs against the friction between the rotary discs and the stationary discs, thereby permitting the internal gear to rotate to absorb the impact torque acting on the planetary gear speed reducer.

The shock absorber is equipped with a case which has formed on an inner periphery of an open end thereof an internal thread into which a nut with an external thread is fastened. The nut is placed in contacting abutment with the disc springs. An initial pressure or load exerted by the disc springs on a stack of the stationary and rotary discs is adjusted as a function of the amount by which the nut is tightened to set a degree of torque (i.e., the slip torque) which will induce the internal gear to slip.

Specifically, the nut of the shock absorber is designed to serve an important role to determine the slip torque which initiates the slippage of the internal gear.

The shock absorber, however, has the following disadvantage.

When the shock absorber is being assembled, the disc spring may be biased in orientation thereof and experience to have an outer periphery caught by the internal thread of the case. In such an event, the pressure, as produced by tightening the nut, will concentrate at portions of the disc spring and the internal gear caught by each other, which leads to a concern about a lack of application of elastic pressure of the disc springs to the stack of the stationary and rotary discs. Additionally, when ridges of the internal thread are squashed, it will result in a lack of tightening the nut to exert the pressure on the stack of the stationary and rotary discs. This leads to a decrease in the slip torque of the internal gear and, in the worst case, an instability in starting the engine.

SUMMARY OF THE INVENTION

It is therefore a principal object of the invention to avoid the disadvantages of the prior art.

It is another object of the invention to provide a starter equipped with an improved structure of a shock absorber designed to ensure the stability in presetting a slit torque which will induce slippage of an internal gear of a planetary gear speed reducer to absorb impact torque exerted thereon.

According to one aspect of the invention, there is provided a starter for an engine such as an automotive internal combustion engine. The starter comprises: (a) a motor working to rotate to output torque; (b) an output shaft on which a pinion gear disposed; (c) a planetary gear speed reducer which is equipped with an internal gear, the planetary gear speed reducing working to reduce a rotational speed of the motor and transmit it to the output shaft for starting an engine; (d) a shock absorber including a rotary disc, a stationary disc, a case in which the rotary disc and the stationary disc are disposed, a load applying mechanism, and a load adjuster, the rotary disc being formed integrally with the internal gear of the planetary gear speed reducer, the stationary disc being arrayed adjacent the rotary disc in a thickness-wise direction of the rotary disc and being held from rotating, the case having an open end and an internal thread formed on an inner periphery of the open end, the load applying mechanism being disposed inwardly of the internal thread of the case in a radius direction of the internal thread to apply a load to the stationary and rotary discs to develop a given degree of friction therebetween, the load adjuster being placed in threadable engagement with the internal thread of the case to achieve adjustment of the load, as applied by the load applying mechanism to the stationary and rotary discs, when a degree of torque greater than a given value acts on the rotary disc through the internal gear, the shock absorber working to induce the rotary disc to rotate against the given degree of friction to absorb the torque to eliminate a physical impact to be exerted on the planetary gear speed reducer; and (e) a restraining mechanism serving to restrain the load applying mechanism from moving in the radius direction of the internal thread to keep a portion of the load applying mechanism, which is located most outwardly in the radius direction of the internal thread, disposed away from a portion of the internal thread which is located most inwardly in the radius direction of the internal thread.

Specifically, the restraining mechanism holds the load applying mechanism from moving in the radius direction of the internal gear, thus avoiding catching of the outer periphery thereby by the internal thread of the case. This causes the load, as produced by the load applying mechanism, to be exerted on an assembly of the stationary and rotary discs without concentrating on the internal thread. The load on the assembly develops the given degree of friction between the stationary and rotary discs to ensure a desired degree of slip torque which acts on and induces the internal gear (i.e., the rotary disc) to slip, in other words, an upper limit of torque within which the internal gear is held from rotating. This minimizes the impact torque acting on the planetary gear speed reducer o ensure the stability in starting the engine.

In the preferred mode of the invention, the restraining mechanism is provided integrally with an adjacent member disposed next to the load applying mechanism in an axial direction of the output shaft. Specifically, the restraining mechanism is machined together with the adjacent member, thus eliminating the need for an additional member to make the restraining mechanism and resulting in a decrease in manufacturing cost.

The restraining mechanism may be implemented by a protrusion that is a portion of the adjacent member which extends in an axial direction of the output shaft to retain an outer periphery of the load applying mechanism in order to avoid the undesirable engagement of the load applying mechanism with the internal gear.

The adjacent member may be a plate having a portion of an outer periphery thereof which is bent to form the protrusion. The protrusion may, therefore, be formed by, for example, a press, thus facilitating ease of making the restraining mechanism.

The load applying mechanism is located adjacent a major surface of the plate in the axial direction. The protrusion of the plate works to restrain the load applying mechanism from moving in the radius direction of the internal thread.

The restraining mechanism may be implemented by protrusions that are portions of an outer periphery of the plate which extend to retain an outer periphery of the load applying mechanism. The shock absorber may have the load applying mechanism as a first load applying mechanism and also include a second load applying mechanism which is disposed inwardly of the internal thread of the case in the radius direction of the internal thread to apply a load to the stationary and rotary discs to develop the given degree of friction between the stationary disc and the rotary disc along with the first load applying mechanism, the first and second load applying mechanism being located adjacent opposed major surfaces of the plate in the axial direction, respectively. The protrusions are broken down into a first and a second group. The first group of the protrusions extend in one of opposite directions substantially perpendicular to a plane of the plate. The second group of the protrusions extending in the other direction. Each of the protrusions of the first group is disposed between adjacent two of the protrusions of the second group. This enables the first and second load applying mechanisms disposed adjacent each other to be restrained from moving in the radius direction simultaneously.

The plate may have formed therein a recess as the restraining mechanism in which an end of the load applying mechanism therein is retained.

The first and second load applying mechanisms are located on opposed sides of the adjacent member. The plate as the adjacent member may have formed therein recesses as the restraining mechanism in which the first and second load applying mechanism are retained and restrained from moving in the radius direction of the internal thread, thereby avoiding the undesirable engagement of the first and second load applying mechanisms with the internal gear.

The first and second load applying mechanisms are restrained from moving in the radius direction of the internal gear by the restraining mechanism so as to be centered to the case of the shock absorber. This results in coincidence between portions of the first and second load applying mechanisms which are placed in abutment with the plate, thereby minimizing the bias of load, as produced by the load adjuster, to achieve a high degree of efficiency of transmitting the load to the stationary and rotary discs.

The plate may have formed on an outer periphery thereof a protrusion which extends outwardly radially thereof and is fit in a recess formed in an inner periphery of the case so that the plate is held from rotating. This avoids undesirable movement of the plate arising from fastening of the load adjuster into the internal thread of the case.

The first and second load applying mechanisms may be located on opposed sides of the plate. The plate is a washer. This permits the first and second load applying mechanisms to be made to be elastically deformable. Specifically, the washer is interposed between the first and second load applying mechanisms to avoid physical interference therebetween when deformed elastically.

The load applying mechanism may be implemented by a disc spring. The disc spring is usually small in drop in elasticity with time, thus resulting in an increase in service life of the starter.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 11(*b*) is a cross sectional view, as taken along the line B-B in FIG. 11(*a*);

FIG. 11(*c*) is a partially enlarged view, as enclosed by a circle C in FIG. 11(*b*);

FIG. 12(*b*) is a cross sectional view, as taken along the line D-D in FIG. 12(*a*); and FIG. 12(*c*) is a partially enlarged view, as enclosed by a circle E in FIG. 12(*b*).

DESCRIPTION OF THE PREFERRED EMBODIMENTS

Figure 1:
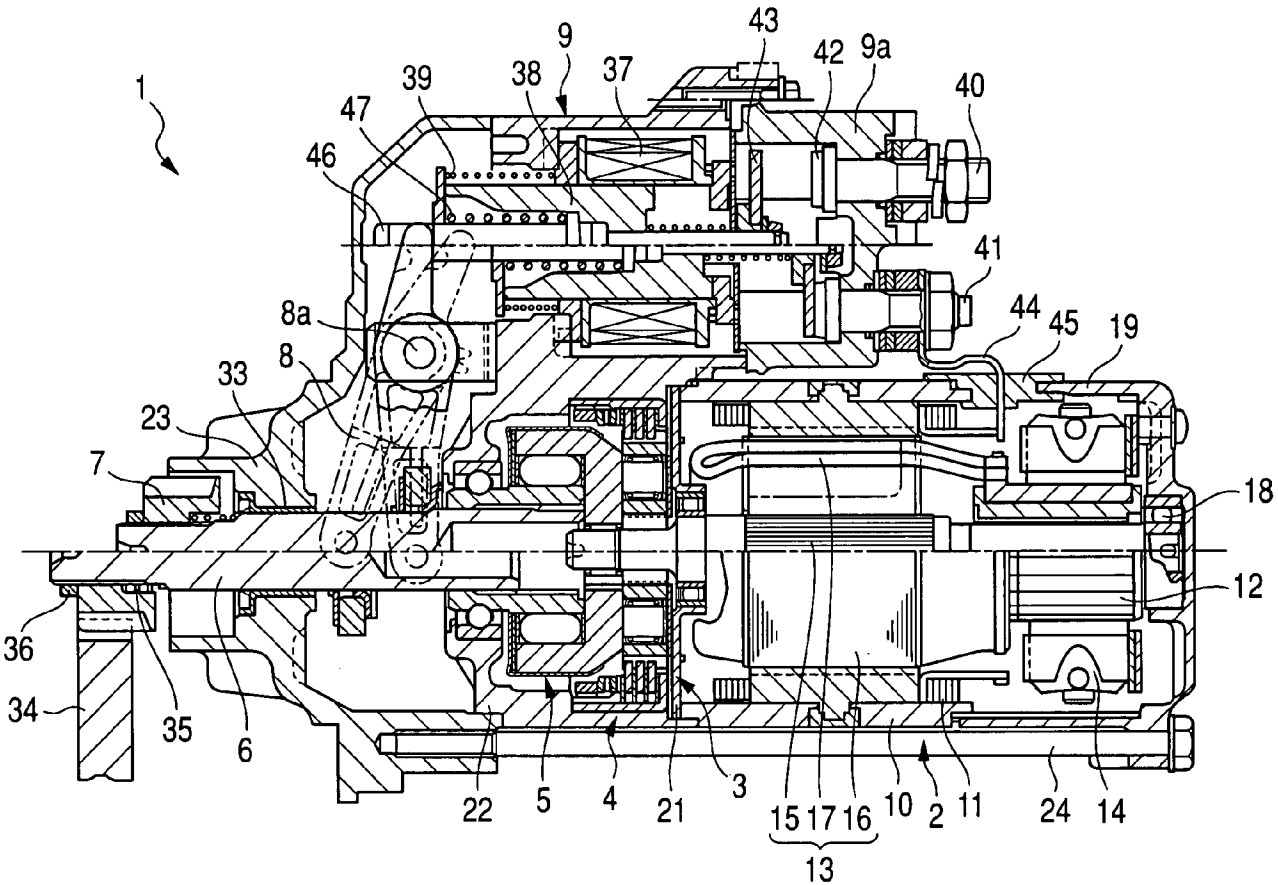
FIG. 1 is a longitudinal sectional view which shows an internal structure of a starter for an engine according to the first embodiment of the invention.

Referring to the drawings, wherein like reference numbers refer to like parts in several views, particularly to FIG. 1, there is shown a starter 1 designed to start, for example, an internal combustion engine.

The starter 1 includes generally an electric motor 2, a speed reducer 3, a shock absorber 4, an output shaft 6, a pinion gear 7, and an electromagnetic switch 9. The motor 2 works to produce torque on an output shaft thereof. The speed reducer 3 works to reduce the speed of the motor 2 and transmit it to the output shaft 6. The shock absorber 4 works to absorb physical impact or shock arising from the cranking of the engine. The output shaft 6 is coupled with the speed reducer 3 through a clutch 5. The pinion gear 7 is fit on the output shaft 6. The electromagnetic switch 9 works to open or close main contacts (which will be described later in detail) installed in a motor driver (which will also be referred to as a motor circuit below) of the electric motor 2 to energize or deenergize the motor 2. The electromagnetic switch 9 also functions to move the output shaft 6 in an axial direction thereof through a shift lever 8. Portions of FIG. 1 above the longitudinal center lines of the output shaft 6 and the electromagnetic switch 9 illustrate the starter 1 placed at rest, while lower portions of FIG. 1 illustrate the starter 1 operating.

The motor 2 is a typical commutator dc motor equipped with a hollow cylindrical yoke 10 forming a magnetic circuit, field coils 11 disposed on an inner circumferential wall of the yoke 9, an armature 13 with a commutator 12, and brushes 14 riding on the surface of the commutator 12. The brushes 14 slide on the commutator 12 during rotation of the armature 13. The field coils 11 may be replaced with permanent magnets.

The armature 13 includes an armature core 16 press-fit on the outer periphery of the armature shaft 15 through serrations and an armature coil 17 wound around the armature core 16. The armature coil 17 is coupled with segments which are arranged in the form of a hollow cylinder to make up the commutator 12. The armature shaft 15 has a rear end which extends rearward of the commutator 12 (i.e., rightward, as viewed in FIG. 1) and is supported by an end frame 19 through a bearing 18 and a front end which extends frontward of the armature core 16 and is supported by a center plate 21 through a bearing 20.

The center plate 21 is disposed between the armature 13 and the speed reducer 3 perpendicular to the armature shaft 15 to block flying of foreign objects such as brush particles toward the speed reducer 3. The center plate 21 is retained at an outer periphery between a center case 22 and a yoke 10.

The center case 22 is disposed between a front housing 23 and the yoke 10 and covers the outer periphery of the clutch 5 and the speed reducer 3. The front housing 23 covers the front of the starter 1.

The center case 22, the yoke 10, and the end frame 19 are, as can be seen in FIG. 1, joined together by a plurality of through-bolts 24 fastened firmly into the front housing 23.

Figure 2:
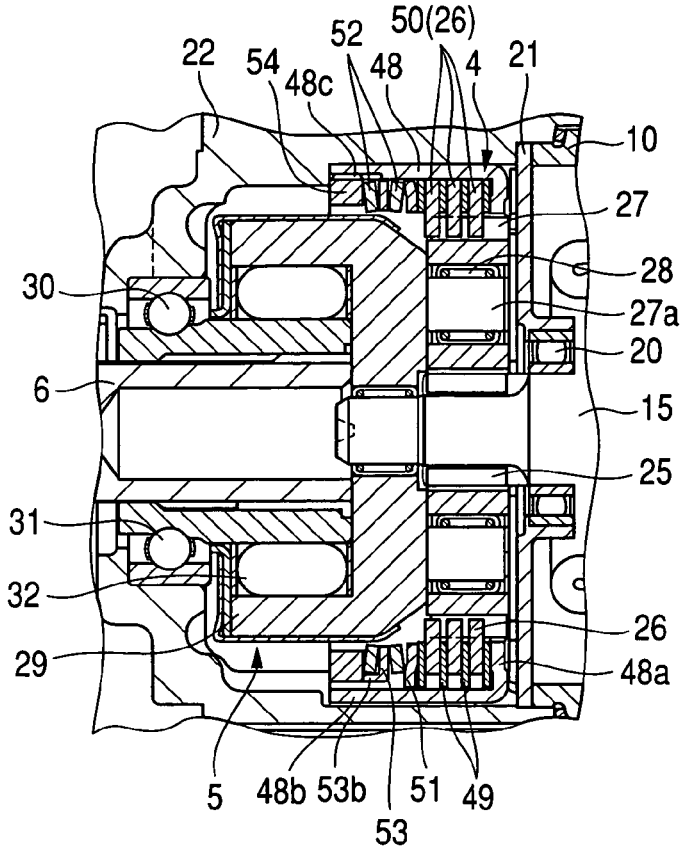
FIG. 2 is a partially sectional view, as taken along a line A-A in FIG. 3, which illustrates an internal structure of a shock absorber installed in the starter of FIG. 1.

The speed reducer 5 is implemented by a typical epicycle reduction gear train (also called a planetary gear speed reducer) and placed coaxially with the armature shaft 15. The speed reducer 5 is located away from the commutator 12 across the armature 13. The speed reducer 5 is, as can be seen in FIG. 1, made up of a sun gear 25, an internal gear 26, and planet gears 27 meshing with the gears 25 and 26. The sun gear 25 is disposed on the end the armature shaft 15 which protrudes from the center plate 21. The internal gear 26 is disposed coaxially with the sun gear 25 and controlled in rotation by the shock absorber 4. The orbital motion of the planet gears 27 is transmitted to the output shaft 6 through the clutch 5. The planet gears 27 are, as illustrated in FIG. 2, supported rotatably by planetary pins 27*a* through bearings 28 (e.g., needle bearings). The planetary pins 27*a* are press-fit in a clutch outer 29, as will be described below in detail.

The clutch 5 is, as illustrated in FIG. 1, interposed between the speed reducer 3 and the output shaft 6 and made up of a clutch outer 29 to which torque output of the motor 2 is transmitted through the speed reducer 3, an inner tube 31 retained to be rotatable by the center case 22 through the bearing 30, and rollers 32 disposed within cam chambers formed in an inner circumference of the clutch outer 29. The rollers 32 work to establish or block transmission of the torque between the clutch outer 29 and the inner tube 31. The clutch 5 works as a one-way clutch to transmit the torque outputted by the motor 2 to the output shaft 6 and block the transmission of torque from the output shaft 6 to the motor 2.

The output shaft 6 is disposed coaxially with the armature shaft 15. The output shaft 6 is retained at an end thereof by the front housing 23 through the bearing 33 to be slidable and rotatable and inserted at the other end thereof into the inner tube 31 and joined thereto through a helical spline.

When it is required to start the engine, the pinion gear 7 is brought into mesh with the ring gear 34 of the engine, as illustrated in FIG. 1, to transmit the torque, as outputted by the motor 2, to the ring gear 34. The pinion gear 7 is joined through serrations to the top end of the output shaft 6 extending frontward of the bearing 33 and urged by a pinion spring 35 installed around the inner circumference of the pinion gear 7 into constant abutment with a stopper 36 disposed on the top end of the output shaft 6.

The electromagnetic switch 9 consists of a magnetic coil 37 and a plunger 38. The magnetic coil 37 functions as an electromagnet when energized by electric power from a battery (not shown). The plunger 38 is slidable along the inner periphery of the magnetic coil 37 in an axial direction thereof. When the magnetic coil 37 is energized, it produces a magnetic attraction to attract the plunger 38 in the rightward direction, as viewed in FIG. 1. The movement of the plunger 38 causes the main contacts of the motor circuit to be closed. When the magnetic coil 37 is deenergized, so that the magnetic attraction disappears, it will cause the plunger 38 to be returned back by the return sparing 39 to open the main contacts.

The main contacts are made up of a pair of fixed contacts 42 and a movable contact 43. The fixed contacts 42 are connected to the motor circuit through external terminals 40 and 41. The movable contact 43 is movable along with the plunger 38 to establish or block electric connection between the fixed contacts 42. When the fixed contacts 42 are joined electrically by the movable contact 43, the main contacts will be closed. Alternatively, when the fixed contacts 42 are disconnected electrically by the movable contact 43, the main contacts will be opened.

The external terminal 40 is a so-called B-terminal connected to the battery installed in the vehicle through a battery cable (not shown). The external terminal 41 is a so-called M-terminal to which a terminal 44 extending from the motor 2 is connected. The external terminals 40 and 41 are retained by a resinous cover 9*a* of the electromagnetic switch 9. The terminal 44 is retained by a grommet 45 nipped between the yoke 10 and the end frame 19 and coupled at one of the ends which is farther from the M-terminal to the field coil 11.

The shift lever 8 has a point 8*a* of support on which the shift lever 8 is swingable. The shift lever 8 is coupled at one of ends opposed to each other across the support point 8*a* with a shifting rod 46 of the electromagnetic switch 9 and engages at the other end with the output shaft 6 to transmit the movement of the plunger 38 to the output shaft 6.

The shifting rod 46 is installed in the plunger 38 of the electromagnetic switch 9 together with a drive spring 47 and works to transmit the movement of the plunger 38 to the shift lever 8 through the drive spring 47.

The structure of the shock absorber 4 will be described below.

The shock absorber 4 is designed to absorb impact torque arising from engagement of the pinion gear 7 with the ring gear 34 for cranking the engine. The shock absorber 4 consists, as illustrated in FIG. 2, of a hollow cylindrical case 48, stationary discs 49, rotary discs 50, a press plate 51, disc springs 52 serving as urging members, a washer 53, and a nut 54.

Figure 3:
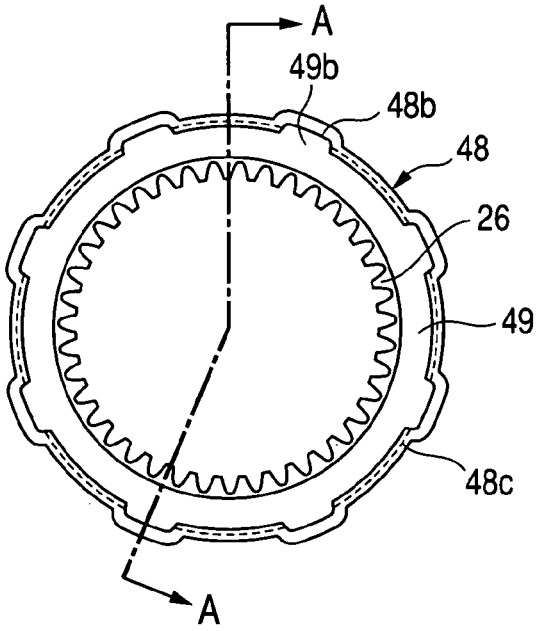
FIG. 3 is a plan view which shows an assembly of stationary and rotary discs and a washer of the shock absorber of FIG. 2.

The case 48 is disposed within the center case 22 to be unrotatable. The case 48 has a cylindrical major body and an annular bottom wall 48*a* which extends inwardly from a right end of the major body, as viewed in FIG. 2. The bottom wall 48*a* has an inner diameter great enough not to interfere mechanically with the planet gears 27 of the speed reducer 3. The case 48 has, as illustrated in FIG. 3, formed in an inner circumference thereof a plurality of recesses 48*b* which retain the stationary discs 49 from rotating. The case 48 also has formed in an inner surface of an open end far away from the bottom wall 48*b* an internal thread 48*c* into which the nut 54 is fastened.

The stationary discs 49 and the rotary discs 50 are laid to overlap alternately to form a disc stack. At outermost sides of the disc stack, the stationary discs 49 are disposed. The disc stack is, as clearly illustrated in FIG. 2, disposed within the case 48.

Figure 4:
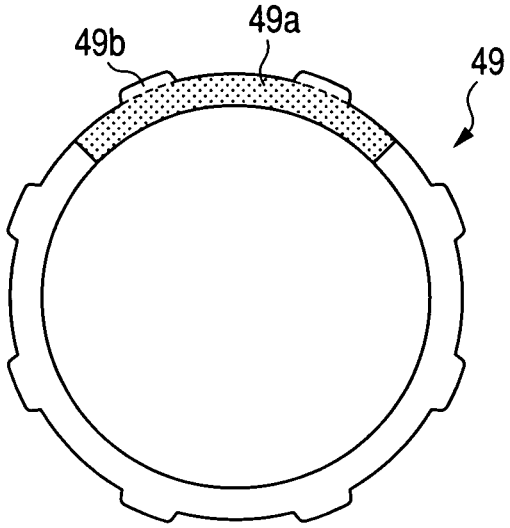
FIG. 4 is a plan view which shows a stationary disc installed in the shock absorber of FIG. 3.

Each of the stationary discs 49 is, as illustrated in FIG. 4, formed by a metallic (e.g., phosphor bronze) annular plate pressed into a ring shape and has a plurality of dimples 49*a* formed in the surface thereof. The stationary disc 49 also has formed on an outer circumference thereof a plurality of protrusions 49*b* which are fit in the recesses 48*b*, as illustrated in FIG. 3, formed in the inner circumference of the case 48 to hold the stationary disc 49 from rotating. The inner diameter of the stationary discs 49 is great enough not to interfere with the planet gears 27 of the speed reducer 3.

Figure 5:
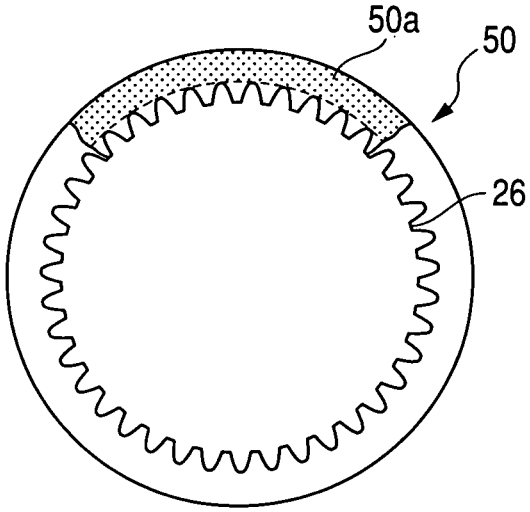
FIG. 5 is a plan view which shows a rotary disc installed in the shock absorber of FIG. 3.

Each of the rotary discs 50 is, as illustrated in FIG. 5, formed by a metallic (e.g., copper) annular plate pressed into a ring shape and has a plurality of dimples 50*a* formed in the surface thereof. The rotary discs 50 have an outer diameter slightly smaller than the inner diameter of the case 48 and is disposed to be rotatable relative to the stationary discs 49. The rotary discs 50, as can be seen in FIG. 5, have formed in the inner circumference thereof teeth which define the internal gear 26 with which the planet gears 27 of the speed reducer 3 mesh, as illustrated in FIG. 2. The rotary discs 50 are formed integrally with the internal gear 26 of the speed reducer 3.

Each of the stationary discs 49 and the rotary discs 50 has lubricant such as grease applied to the surface thereof.

The press plate 51 is, like the stationary discs 49, shaped in the form of a ring and disposed on one of ends of the stack of the stationary discs 49 and the rotary discs 50 which is farther away from the bottom wall 48*a* of the case 48.

The disc springs 52 serves to exert the mechanical pressure on the stack of the stationary discs 49 and the rotary discs 50 to create the friction between each of the stationary discs 49 and an adjacent one of the rotary discs 50. FIG. 2 illustrates the two disc springs 52 between which the washer 53 is installed, but however, only either one of the disc springs 52 may alternatively be disposed.

Figure 6:
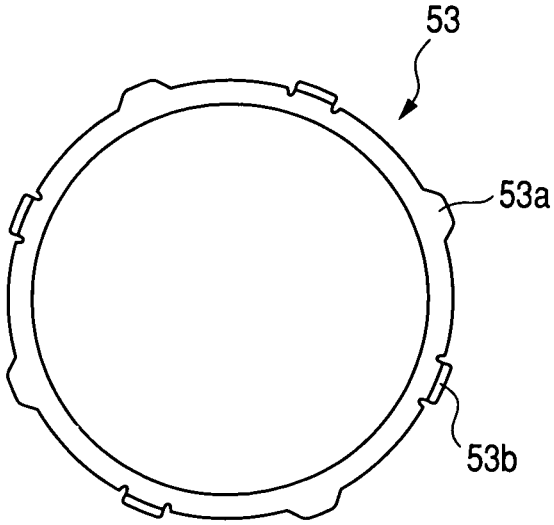
FIG. 6 is a plan view which shows a washer installed in the shock absorber of FIG. 3.

The washer 53 is interposed between the disc springs 52 to avoid the interference of elastic deformation of the disc springs 52 with each other. Specifically, the washer 53 is disposed adjacent the disc springs 52 in contacting abutment with inner peripheries of the disc springs 52. The washer 53 has, as illustrated in FIG. 6, a plurality of protrusions 53*a* projecting outward in a radius direction thereof which are fit in the recesses 48*b* formed in the inner periphery of the case 48 to hold the washer 53 from rotating.

Figure 7:
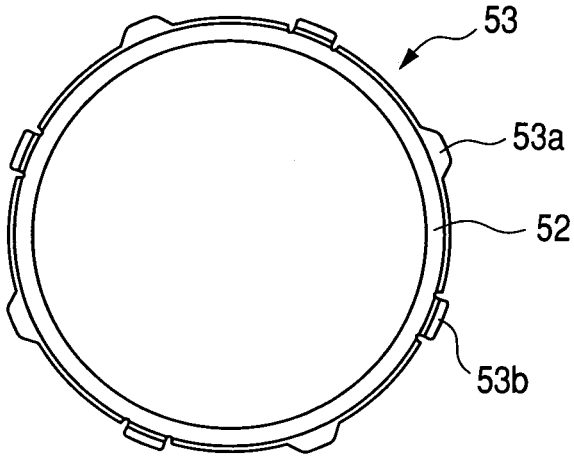
FIG. 7 is a plan view which shows an assembly of the washer of FIG. 6 and a disc spring held by the washer from rotating in the shock absorber of FIG. 3.

The ends of some of the protrusions 53*a* are bent by a press in the axial direction of the shock absorber 4, i.e., a direction perpendicular to the plane of the washer 53 to form claws (i.e., protrusions) 53*b* which retain, as illustrated in FIG. 7, the outer periphery of one of the disc springs 52 to restrain the one of the disc springs 52 from moving in the radius direction thereof. The claws 53*b* are also fit in the recesses 48*b* of the case 48 to hold the washer 53 from rotating.

Figure 8:
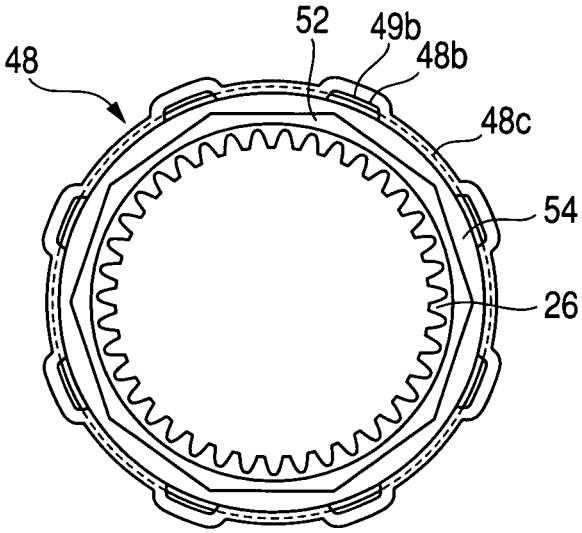
FIG. 8 is a plan view which shows the shock absorber of FIG. 3, as viewed from a nut.

The nut 54 is, as can be seen in FIG. 8, fastened to the internal thread 48*c* of the case 48 to adjust an initial load to be exerted by the disc springs 52 on the stack of the stationary discs 49 and the rotary discs 50 which sets a given degree of slip torque acting on the rotary discs 50 which causes the rotary discs 50 to start to rotate or slip relative to the stationary discs 49.

In operation of the starter 1, when a start switch (not shown) is closed, the magnetic coil 37 of the electromagnetic switch 9 is energized to attract the plunger 38. The movement of the plunger 38 is transmitted to the output shaft 6 through the shift lever 8, thereby causing the output shaft 6 to be moved (i.e., the leftward, as viewed in FIG. 1) away from the motor 2 while being rotated relative to the inner tube 31 by the helical spline. Upon hitting of the end surface of the pinion gear 7 against the end surface of the ring gear 34, the pinion gear 7 stops temporarily while compressing the pinion spring 35.

Afterwards, when the plunger 38 is further moved while the reactive pressure is being accumulated in the drive spring 47, and the main contacts are closed, it will cause the battery to supply the electric power to the motor 2. The armature 13 then produces torque. The rotation of the armature 13 is reduced in speed by the speed reducer 3 and transmitted to the output shaft 6 through the clutch 5, thereby rotating the output shaft 6. At the time when the pinion gear 7 has rotated to an angular position where the pinion gear 7 is engageble with the ring gear 34, the reactive pressure, as accumulated in the drive spring 47, acts on the pinion gear 7 to bring each of the teeth of the pinion gear 7 into between adjacent two of the teeth of the ring gear 34. Specifically, the pinion gear 7 engages the ring gear 34 to transmit the torque output of the motor 2, as amplified by the speed reducer 3, to the ring gear 34, thereby cranking the engine.

At the moment the torque of the pinion gear 7 is exerted on the ring gear 34 to crank the engine, the physical impact will arise and act on the pinion gear 7, which is, in turn, transmitted as impact torque to the output shaft 6, to the inner tube 31, to the rollers 32, to the clutch outer 29, to the planetary pins 27*a*, to the planet gears 27, and to the internal gear 26. When the degree of the impact torque acting on the internal gear 26 exceeds the slip torque of the rotary disc 50, it will cause the rotary disc 50 to rotate against the friction developed between the rotary discs 50 and the stationary discs 49, thereby absorbing the impact.

When the engine has started up completely, the start switch is opened. The magnetic coil 37 is then deenergized, so that the magnetic attraction disappears. This causes the plunger 38 to be pushed back by the return spring 39 to open the main contacts, thereby cutting the supply of electric power from the battery to the motor 2. The armature 13 is decelerated gradually and then stopped.

When the plunger 38 is pushed back by the return spring 39, it will cause the shift lever 8 to swing in a direction opposite that when the engine is started, thereby backing the output shaft 6.

The shock absorber 4 is, as described above, designed to restrain the disc spring 52 from moving in the radius direction thereof, thereby avoiding catching or undesirable engagement of the outer circumference of the disc spring 52 with the internal thread 48*c* formed on the inner circumference of the case 48. This causes the load, as produced by fastening the nut 54, to be exerted on the stack of the stationary discs 49 and the rotary discs 50 through the disc springs 52 without concentrating on the internal thread 48*c*. The load on the stack develops the given degree of friction between the stationary discs 49 and the rotary discs 50 to ensure a desired degree of the slip torque which acts on and induces the internal gear 26 to slip, in other words, an upper limit of torque within which the internal gear 26 (i.e., the rotary discs 50) is held from rotating. This minimizes the impact torque acting on the speed reducer 3 to ensure the stability in starting the engine.

The washer 53 is, as described above, held from rotating, thereby restraining the movement of the washer 52 arising from tightening of the nut 54. This ensures the stability in exerting the pressure or load on the washer 53 to set the slip torque accurately.

The washer 53 disposed between the disc springs 52 to avoid the interference of elastic deformation therebetween has the claws 53*b* which restrain the disc spring 52 from moving in the radius direction thereof, thus securing the washer 53 without use of additional parts.

The starter 1 of the second embodiment will be described below.

The shock absorber 4 of the first embodiment, as described above, restrains one of the disc springs 52 which is located closer to the nut 54 from moving in the radius direction thereof. The shock absorber 4 of the second embodiment is designed to restrains both the disc springs 52 from moving in the radius direction.

Figure 9:
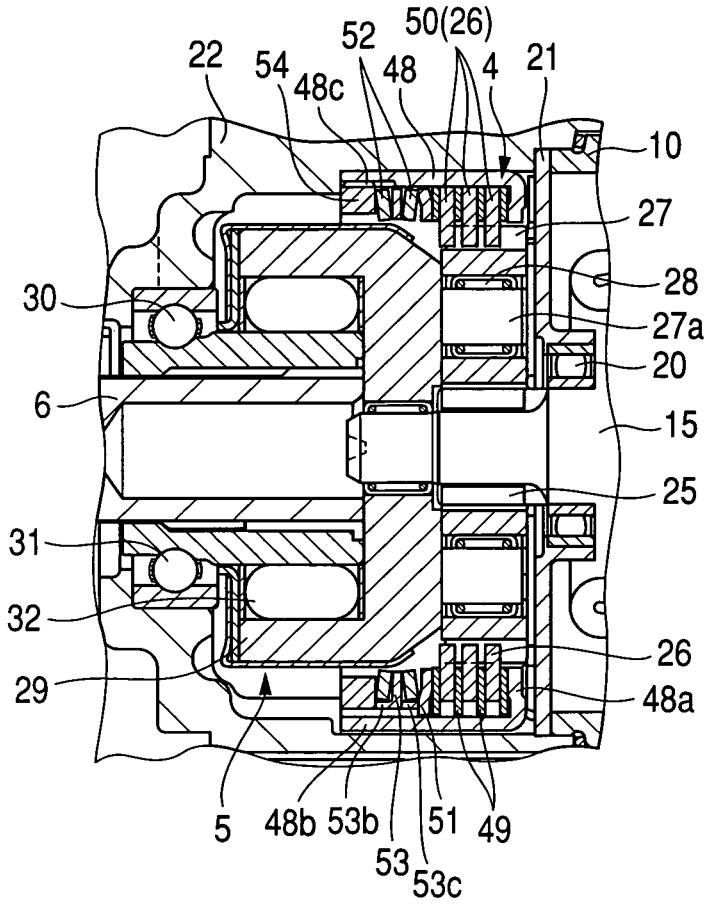
FIG. 9 is a partially sectional view which illustrates an internal structure of a shock absorber according to the second embodiment of the invention.
Figure 10:
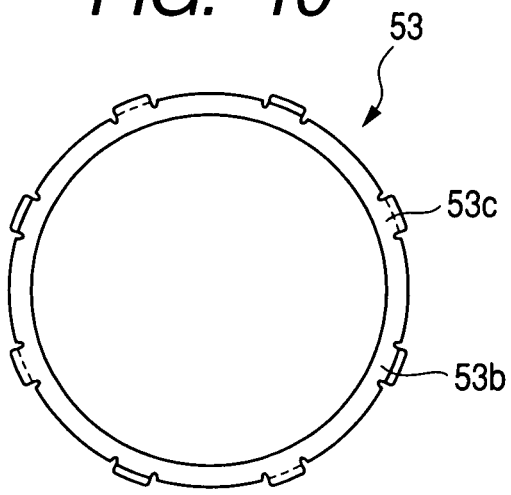
FIG. 10 is a plan view which shows a washer installed in the shock absorber of FIG. 9.

Specifically, the protrusions 53*a* of the washer 53, as illustrated in FIG. 7, are bent in a direction opposite that in which the claws 53*b* extend, that is, toward the internal gear 26 to form, as illustrated in FIG. 9, claws 53*c* in addition to the claws 53*b*. In other words, the protrusions 53*a* of the washer 53 are broken down into a first group of the claws 53*b* and a second group of the claws 53*c*. The first group of the claws 53*b* extend in one of opposite axial directions of the washer 53 (i.e., opposite axial directions of the output shaft 6, while the second group of the claws 53*c* extend in the other axial direction. The claws 53*b*, like in the first embodiment, engage one of the disc springs 52 which is closer to the nut 54. The claws 53*c* engage the other disc spring 52 to restrain it from moving in the radius direction thereof. The claws 53*b* and 53*c* are, as can be seen in FIG. 10, arrayed alternately in the circumferential direction of the washer 53. In other words, each of the first group of the claws 53*b* is located between adjacent two of the second group of the claws 53*c* in the circumferential direction of the washer 53. The claws 53*c*, like the claws 53*b* of the first embodiment, are fit in the recesses 48*b* of the case 48, to hold the washer 53 from rotating.

The washer 53 is, as apparent from the above, designed to restrain both the disc springs 52 from moving in the radius direction thereof simultaneously, thus avoiding undesirable engagement of the outer circumference of the disc springs 52 with the internal thread 48*c* of the case 48. The alternate locations of the claws 53*b* and 53*c* over the circumference of the washer 53 results in exertion of uniform pressure on the outer circumference of the washer 53 to ensure the proper alignment of the center of the washer 53 with that of the case 48. This results in coincidence between portions of the inner circumferential surfaces of the two disc springs 52 placed in contacting abutment with the washer 53 within a range of, for example, 0.0 to 0.5 mm, thereby minimizing the bias of load, as produced by tightening the nut 54, on the disc springs 52 to achieve a high degree of efficiency of transmitting the load to the stack of the stationary discs 49 and the rotary discs 50.

The washer 53 is, like in the first embodiment, held from rotating, thereby restraining the movement of the washer 52 arising from tightening of the nut 54. This ensures the stability in exerting the pressure or load on the washer 53 to set the slip torque accurately.

The starter 1 of the third embodiment will be described below.

Figure 11A:
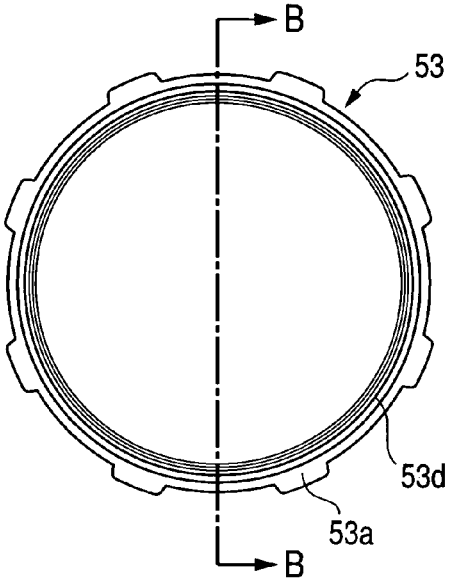
FIG. 11(*a*) is a plan view which shows a washer according to the third embodiment of the invention.
Figure 11B:
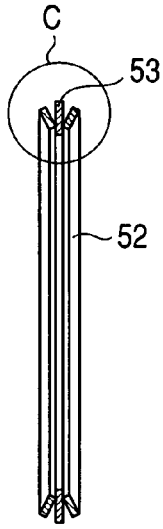
Figure 11C:
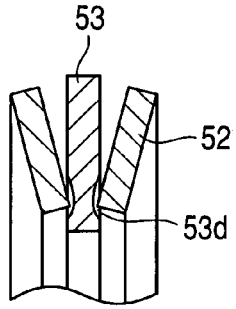

The shock absorber 4 of the second and third embodiments is designed to hold the disc spring(s) 52 from moving in the radius direction thereof using the claws 53*b* and/or 53*c*. The shock absorber 4 of this embodiment is designed to have annular grooves 53*d*, as illustrated in FIGS. 11(*a*), 11(*b*), and 11(*c*), formed in major surfaces of the washer 53 facing the disc springs 52. Specifically, the annular grooves 53*d* are formed by, for example, a press coaxially in the opposed surfaces of the washer 53. The disc springs 52, as clearly illustrated in FIG. 11(*c*), have inner circumferential corners or edges which face each other in the axial direction of the washer 53 and are fit in the annular grooves 53*d* to restrain the disc springs 52 from moving in the radius direction thereof.

The engagement of the circumferential edges of the disc springs 52 with the annular grooves 53*d* of the washer 53, like in the first and second embodiments, avoids undesirable engagement of the outer circumference of the disc springs 52 with the internal thread 48*c* of the case 48.

The starter 1 of the fourth embodiment will be described below which is a modification of the one of the third embodiment.

Figure 12A:
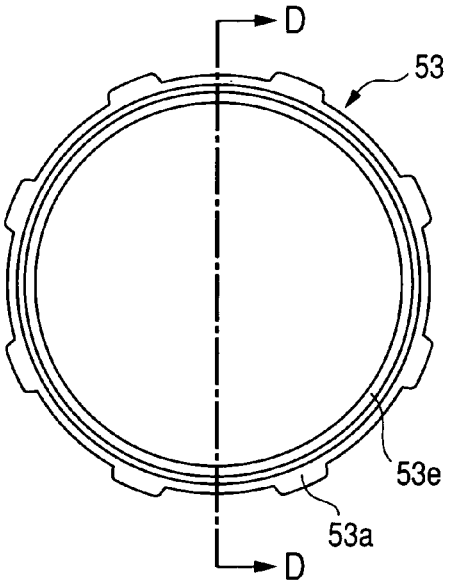
FIG. 12(*a*) is a plan view which shows a washer according to the fourth embodiment of the invention.
Figure 12B:
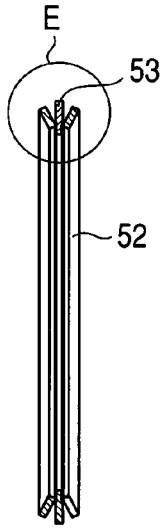
Figure 12C:
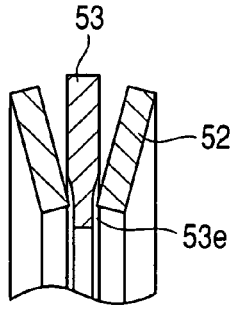

Specifically, the washer 53 of the shock absorber 4 has, as illustrated in FIGS. 12(*a*), 12(*b*), and 12(*c*), annular recesses 53*e* formed in inner circumferential portion of the major opposed surfaces thereof. The annular recesses 53*e* are formed by grinding or cutting the surfaces of the washer 53 around the center hole of the washer 53. The disc springs 52, as clearly illustrated in FIG. 12(*c*), have inner circumferential corners or edges which face each other in the axial direction of the washer 53 and are fit in the annular recesses 53*e* to restrain the disc springs 52 from moving in the radius direction thereof.

The engagement of the circumferential edges of the disc springs 52 with the annular recesses 53*e* of the washer 53, like in the first to third embodiments, avoids undesirable engagement of the outer circumference of the disc springs 52 with the internal thread 48*c* of the case 48.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

The nut 54 or the press plate 51 may alternatively be designed, like the washer 53, to hold the disc spring(s) 52 from moving in the radius direction thereof.

The shock absorber 4 of the third or fourth embodiments may be designed to place the disc springs 52 in contacting abutment of outer peripheries thereof with the washer 53 and form the annular grooves 53*d* or the annular recesses 53*e* in the washer 53 at a location where the outer peripheries of the disc springs 52 are fit therein.

The shock absorber 4 may alternatively be designed to have discrete grooves or recesses formed in the washer 53 instead of the annular grooves 53*d* or the annular recesses 53*e* and also formed on the disc springs 52 protrusions or claws which are to be fit in the grooves or recesses of the washer 53.

The shock absorber 4 in any of the first to fourth embodiments may alternatively be designed to have any other elastic members such as wave-springs instead of the disc springs 52.

What is claimed is:

1. A starter for an engine comprising:

a motor working to rotate to output torque;

an output shaft on which a pinion gear disposed;

a planetary gear speed reducer which is equipped with an internal gear, said planetary gear speed reducing working to reduce a rotational speed of said motor and transmit it to said output shaft for starting an engine;

a shock absorber including a rotary disc, a stationary disc, a case in which the rotary disc and the stationary disc are disposed, a load applying mechanism, and a load adjuster, the rotary disc being formed integrally with the internal gear of said planetary gear speed reducer, the stationary disc being arrayed adjacent the rotary disc in a thickness-wise direction of the rotary disc and being held from rotating, the case having an open end and an internal thread formed on an inner periphery of the open end, the load applying mechanism being disposed inwardly of the internal thread of the case in a radius direction of the internal thread to apply a load to the stationary and rotary discs to develop a given degree of friction therebetween, the load adjuster being placed in threadable engagement with the internal thread of the case to achieve adjustment of the load, as applied by the load applying mechanism to the stationary and rotary discs, when a degree of torque greater than a given value acts on the rotary disc through the internal gear, said shock absorber working to induce the rotary disc to rotate against the given degree of friction to absorb the torque to eliminate a physical impact to be exerted on said planetary gear speed reducer; and a restraining mechanism serving to restrain the load applying mechanism from moving in the radius direction of the internal thread to keep a portion of the load applying mechanism, which is located most outwardly in the radius direction of the internal thread, disposed away from a portion of the internal thread which is located most inwardly in the radius direction of the internal thread.

2. A starter as set forth in claim 1, wherein said restraining mechanism is provided integrally with an adjacent member disposed next to said load applying mechanism in an axial direction of said output shaft.

3. A starter as set forth in claim 2, wherein said restraining mechanism is implemented by a protrusion that is a portion of said adjacent member which extends in an axial direction of said output shaft to retain an outer periphery of said load applying mechanism.

4. A starter as set forth in claim 3, wherein said adjacent member is a plate having a portion of an outer periphery thereof which is bent to form the protrusion.

5. A starter as set forth in claim 4, wherein the load applying mechanism is located adjacent a major surface of the plate in the axial direction, and wherein the protrusion of the plate works to restrain the load applying mechanism from moving in the radius direction of the internal thread.

6. A starter as set forth in claim 2, wherein said adjacent member is a plate, wherein said restraining mechanism is implemented by protrusions that are portions of an outer periphery of the plate which extend to retain an outer periphery of said load applying mechanism, wherein said shock absorber has the load applying mechanism as a first load applying mechanism and also includes a second load applying mechanism which is disposed inwardly of the internal thread of the case in the radius direction of the internal thread to apply a load to the stationary and rotary discs to develop the given degree of friction between the stationary disc and the rotary disc along with the first load applying mechanism, the first and second load applying mechanism being located adjacent opposed major surfaces of the plate in the axial direction, respectively, and wherein the protrusions are broken down into a first and a second group, the first group of the protrusions extending in one of opposite directions substantially perpendicular to a plane of the plate, the second group of the protrusions extending in the other direction, each of the protrusions of the first group being disposed between adjacent two of the protrusions of the second group.

7. A starter as set forth in claim 2, wherein said adjacent member is a plate which has formed therein a recess as said restraining mechanism in which an end of the load applying mechanism therein is retained.

8. A starter as set forth in claim 2, wherein said shock absorber has the load applying mechanism as a first load applying mechanism and also includes a second load applying mechanism which is disposed inwardly of the internal thread of the case in the radius direction of the internal thread to apply a load to the stationary and rotary discs to develop the given degree of friction between the stationary disc and the rotary disc along with the first load applying mechanism, the first and second load applying mechanisms being located on opposed sides of said adjacent member and wherein said adjacent member is a plate which has formed therein recesses as said restraining mechanism in which the first and second load applying mechanism are retained and restrained from moving in the radius direction of the internal thread.

9. A starter as set forth in claim 6, wherein the first and second load applying mechanisms are restrained from moving in the radius direction of the internal gear by said restraining mechanism so as to be centered to the case of said shock absorber.

10. A starter as set forth in claim 8, wherein the first and second load applying mechanisms are restrained from moving in the radius direction of the internal gear by said restraining mechanism so as to be centered to the case of said shock absorber.

11. A starter as set forth in claim 4, wherein the plate has formed on an outer periphery thereof a protrusion which extends outwardly radially thereof and is fit in a recess formed in an inner periphery of the case so that the plate is held from rotating.

12. A starter as set forth in claim 4, wherein said shock absorber has the load applying mechanism as a first load applying mechanism and also includes a second load applying mechanism which is disposed inwardly of the internal thread of the case in the radius direction of the internal thread to apply a load to the stationary and rotary discs to develop the given degree of friction between the stationary disc and the rotary disc along with the first load applying mechanism, the first and second load applying mechanisms being located on opposed sides of the plate, and wherein the plate is a washer.

13. A starter as set forth in claim 1, wherein the load applying mechanism is implemented by a disc spring.

* * * * *